US010962239B2

(12) United States Patent
Watanabe et al.

(10) Patent No.: US 10,962,239 B2
(45) Date of Patent: Mar. 30, 2021

(54) OUTDOOR UNIT OF AIR-CONDITIONING APPARATUS

(71) Applicant: Mitsubishi Electric Corporation, Tokyo (JP)

(72) Inventors: Takahiro Watanabe, Tokyo (JP); Kazuho Ito, Tokyo (JP); Tomoya Yanase, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/330,214

(22) PCT Filed: Dec. 5, 2016

(86) PCT No.: PCT/JP2016/086005
§ 371 (c)(1),
(2) Date: Mar. 4, 2019

(87) PCT Pub. No.: WO2018/104990
PCT Pub. Date: Jun. 14, 2018

(65) Prior Publication Data

US 2019/0285288 A1 Sep. 19, 2019

(51) Int. Cl.
*F24F 1/22* (2011.01)
*F24F 13/20* (2006.01)
(Continued)

(52) U.S. Cl.
CPC ..... *F24F 1/22* (2013.01); *F24F 1/20* (2013.01); *F24F 1/46* (2013.01); *F24F 11/89* (2018.01);
(Continued)

(58) Field of Classification Search
CPC ..... F24F 1/06; F24F 1/20; F24F 1/22; F24F 1/46; F24F 11/89; F24F 13/20; F24F 2013/207; F25D 29/005; F25B 49/00
See application file for complete search history.

(56) References Cited

U.S. PATENT DOCUMENTS

2010/0294466 A1* 11/2010 Shimaoka ..... F24F 1/54 165/104.33

FOREIGN PATENT DOCUMENTS

CN 203718977 U 7/2014
CN 106016503 A 10/2016
(Continued)

OTHER PUBLICATIONS

International Search Report of the International Searching Authority dated Feb. 28, 2017 for the corresponding international application No. PCT/JP2016/086005 (and English translation).
(Continued)

*Primary Examiner* — Joseph F Trpisovsky
(74) *Attorney, Agent, or Firm* — Posz Law Group, PLC

(57) ABSTRACT

An outdoor unit of an air-conditioning apparatus includes a fan chamber, a machine chamber, a partition plate, and an electrical component unit. The partition plate is provided, in its upper part, with a planar receiving surface portion for receiving a holder. The holder is provided with a positioning protrusion protruding downward. A cutout portion into which the positioning protrusion is inserted is formed in the receiving surface portion. At least one inclined surface portion that is inclined downward from the receiving surface portion and guides the positioning protrusion to the cutout portion is provided at an end portion of the receiving surface portion that leads to the cutout portion.

7 Claims, 10 Drawing Sheets

(51) Int. Cl.

| | |
|---|---|
| *F24F 1/46* | (2011.01) |
| *F24F 1/20* | (2011.01) |
| *F24F 11/89* | (2018.01) |
| *F25B 49/00* | (2006.01) |
| *F25D 29/00* | (2006.01) |

(52) U.S. Cl.
CPC ..... *F24F 13/20* (2013.01); *F24F 2013/207* (2013.01); *F25B 49/00* (2013.01); *F25D 29/005* (2013.01)

(56) References Cited

FOREIGN PATENT DOCUMENTS

| | | | |
|---|---|---|---|
| EP | 2 455 674 | A1 | 5/2012 |
| JP | 2003-246247 | A | 9/2003 |
| JP | 2003-269747 | A | 9/2003 |
| JP | 2005-147466 | A | 6/2005 |
| JP | 2006-064208 | A | 3/2006 |
| JP | 2010-175228 | A | 8/2010 |
| JP | 2011-021776 | A | 2/2011 |
| JP | 2016-043748 | A | 4/2016 |

OTHER PUBLICATIONS

Extended European Search Report dated Oct. 21, 2019 for the corresponding EP application No. 16923212.1.
Office Action dated Jun. 2, 2020 issued in corresponding JP patent application No. 2018-555325 (and English translation).
Office Action dated Jun. 2, 2020 issued in corresponding CN patent application No. 201680091267.3 (and English translation).
Office Action dated Dec. 8, 2020 issued in corresponding JP patent application No. 2018-555325 (and English translation).
Office Action dated Jan. 26, 2021 issued in corresponding CN patent application No. 201680091267.3 (and English machine translation).
Office Action dated Dec. 9, 2020 issued in corresponding EP patent application No. 16923212.1.

* cited by examiner

OUTDOOR UNIT OF AIR-CONDITIONING APPARATUS

CROSS REFERENCE TO RELATED APPLICATION

This application is a U.S. national stage application of PCT/JP2016/086005 filed on Dec. 5, 2016, the contents of which are incorporated herein by reference.

TECHNICAL FIELD

The present invention relates to an outdoor unit of an air-conditioning apparatus in which the fixing position of an electrical component unit is determined and the electrical component unit is mounted.

BACKGROUND ART

In a conventional outdoor unit of an air-conditioning apparatus, when mounting an electrical component unit, the electrical component unit is positioned by inserting a protruding portion of a cover of the electrical component unit into an insertion hole provided in a partition plate. Then, the electrical component unit is screw-fixed from the upper part of the outdoor unit of an air-conditioning apparatus (see, for example, Patent Literature 1).

CITATION LIST

Patent Literature

Patent Literature 1: Japanese Unexamined Patent Application Publication No. 2005-147466

SUMMARY OF INVENTION

Technical Problem

In an outdoor unit of an air-conditioning apparatus, generally, an electrical component unit is disposed in the upper part of the outdoor unit of an air-conditioning apparatus to avoid trouble caused by dew condensation water in the refrigerant pipe or dripping of drain water generated during operation. However, the increase in the size of the outdoor unit of an air-conditioning apparatus accompanying the recent expansion of the cooling and heating capacity has resulted in an increase in the height of the outdoor unit due to an increase in the number of rows of the heat exchanger for the purpose of increasing the capacity.

As a result, when the outdoor unit of an air-conditioning apparatus is placed on the work table at the time of manufacture of the outdoor unit of an air-conditioning apparatus, the mounting position of the electrical component unit becomes so high that it is difficult for the worker to visually check and to determine the fixing position of the electrical component unit. Therefore, it may be necessary for the worker to climb on a step stool to a height at which the worker can visually check the screw hole to reliably mount the electrical component unit. As a result, the work efficiency at the time of manufacture is deteriorated.

The present invention is aimed at solving the above problem, and an object thereof is to provide an outdoor unit of an air-conditioning apparatus in which when an electrical component unit is mounted, the fixing position of the electrical component unit is easily determined, and the work efficiency at the time of manufacture is improved.

Solution to Problem

An outdoor unit of an air-conditioning apparatus of an embodiment of the present invention includes a fan chamber in which a fan is provided and a machine chamber in which a compressor is provided, a partition plate separating the fan chamber and the machine chamber, and an electrical component unit having a control board on which an electrical component is mounted and a holder that holds the control board and is fixed to an upper part of the partition plate. The partition plate is provided with, in its upper part, a planar receiving surface portion for receiving the holder. The holder is provided with a positioning protrusion protruding downward. A cutout portion into which the positioning protrusion is inserted is formed in the receiving surface portion. At least one inclined surface portion that is inclined downward from the receiving surface portion and guides the positioning protrusion to the cutout portion is provided at an end portion of the receiving surface portion that leads to the cutout portion.

Advantageous Effects of Invention

According to the outdoor unit of an air-conditioning apparatus of an embodiment of the present invention, at least one inclined surface portion that is inclined downward from the receiving surface portion and guides the positioning protrusion to the cutout portion is provided at an end portion of the receiving surface portion that leads to the cutout portion. Whereby, the positioning protrusion is guided smoothly to the cutout portion by the inclined surface portion, and the positioning protrusion can be positioned in the cutout portion. Therefore, when the electrical component unit is mounted, the fixing position of the electrical component unit is easily determined, and the work efficiency at the time of manufacturing can be improved.

DESCRIPTION OF EMBODIMENTS

Figure 1:
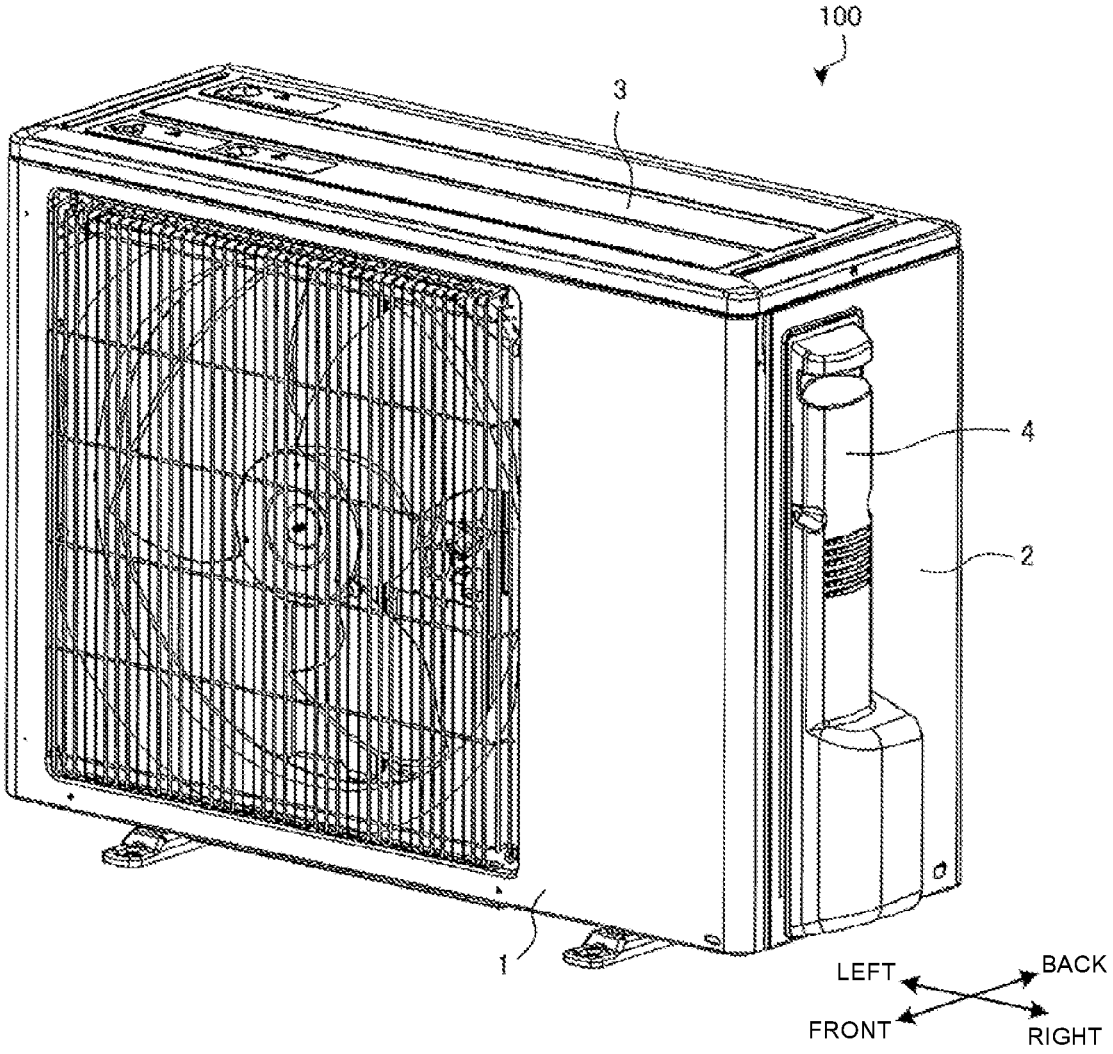
FIG. 1 is a perspective view showing an external appearance of an outdoor unit of an air-conditioning apparatus according to Embodiment 1 of the present invention.

Hereinafter, an outdoor unit of an air-conditioning apparatus in the present invention will be described with reference to the drawings. In the following drawings, the relationship of sizes of the components may differ from that of actual ones. In the following drawings, those denoted by the same reference numerals are the same or equivalent, and this applies throughout the entire text of the specification. Furthermore, the forms of components described in the full text of the specification are merely illustrative, and the present invention should not be limited to these descriptions.

Embodiment 1

Figure 2:
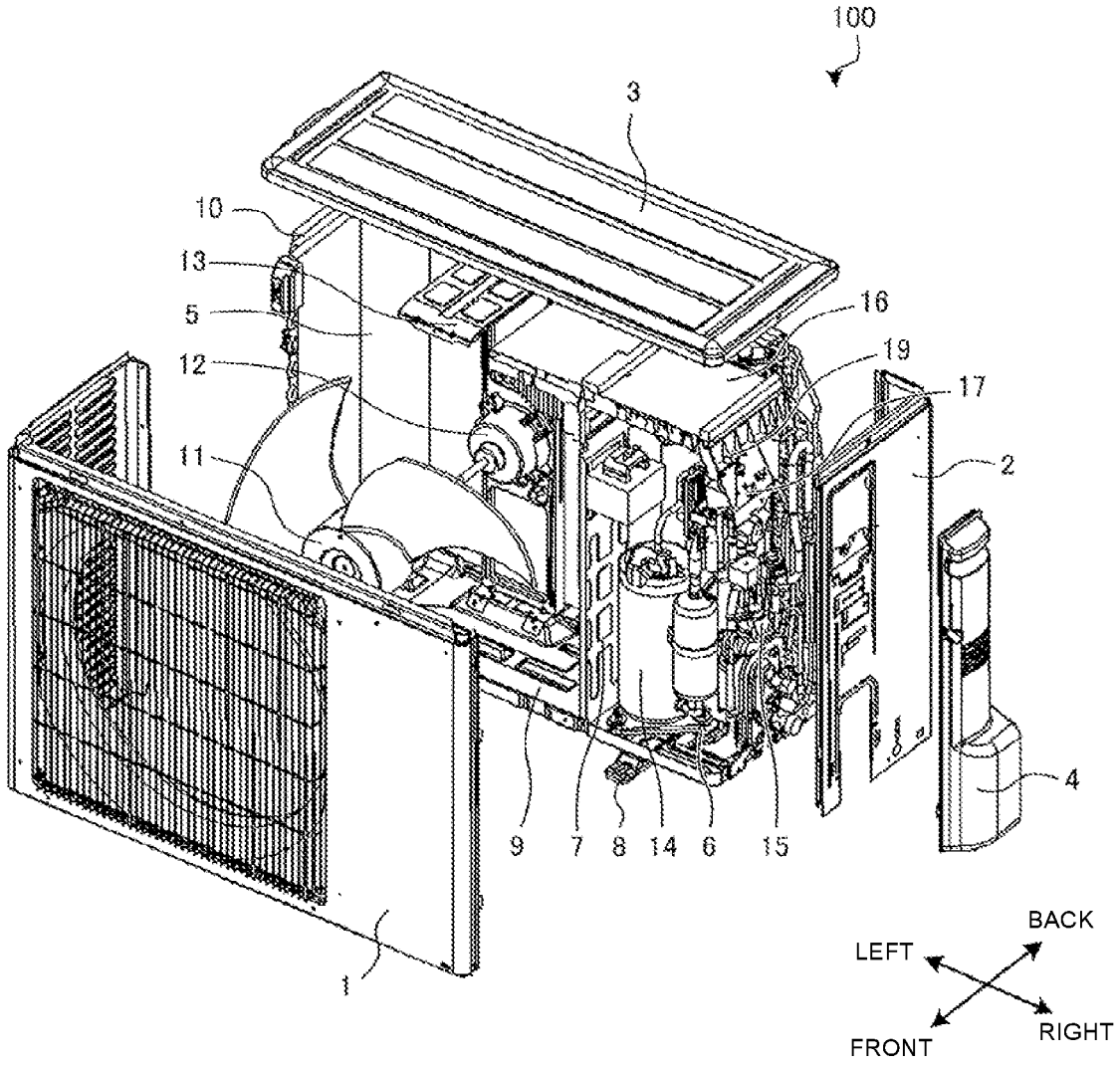
FIG. 2 is an exploded perspective view showing the interior of the outdoor unit of an air-conditioning apparatus according to Embodiment 1 of the present invention.

FIG. 1 is a perspective view showing an external appearance of an outdoor unit 100 of an air-conditioning apparatus according to Embodiment 1 of the present invention. FIG. 2 is an exploded perspective view showing the interior of the outdoor unit 100 of an air-conditioning apparatus according to Embodiment 1 of the present invention. As shown in FIGS. 1 and 2, the outline of the outdoor unit 100 of an air-conditioning apparatus is covered by a front plate 1, a side plate 2, a top plate 3, and a protective cover 4. In the outdoor unit 100 of an air-conditioning apparatus, a fan chamber 5 and a machine chamber 6 are provided. The fan chamber 5 and the machine room 6 are separated by an upright partition plate 7. Components inside the outdoor unit 100 of an air-conditioning apparatus are held on the bottom surface of a bottom plate 9 having leg portions 8.

A heat exchanger 10, a propeller fan 11 disposed in front of the heat exchanger 10, a motor 12 to which the propeller fan 11 is attached, and a motor mounting base 13 holding the motor 12 are provided in the fan chamber 5.

When the propeller fan 11 operates, air flows into the outdoor unit 100 of an air-conditioning apparatus from the back and the left through the heat exchanger 10. The air flowing into the outdoor unit 100 of an air-conditioning apparatus flows through the heat exchanger 10 in the ventilation direction, passes through the propeller fan 11, and flows out to the front of the outdoor unit 100 of an air-conditioning apparatus. Thus, for example, during the cooling operation, the refrigerant in the heat exchanger 10 is cooled by heat exchange with inflowing air, and the air passing through the heat exchanger 10 is heated after heat exchange with the refrigerant. For example, during the heating operation, the refrigerant in the heat exchanger 10 is heated by heat exchange with inflowing air, and the air passing through the heat exchanger 10 is cooled after heat exchange with the refrigerant.

A compressor 14, a refrigerant pipe 15, an electrical component unit 16, and a power supply board 17 are provided in the machine chamber 6. The refrigerant sent from an indoor unit (not shown) is compressed by the compressor 14, passes through the refrigerant pipe 15, and is sent to the heat exchanger 10. The electrical component unit 16 has a control board 18 on which electrical components for controlling the air-conditioning apparatus are mounted, and supplies power to each component. The electrical component unit 16 has a substantially cuboid shape that is thin in the vertical direction. The power supply board 17 draws electricity from the power supply to the control board 18. A terminal block 19 for connecting the outdoor unit 100 of an air-conditioning apparatus and the indoor unit (not shown) with a communication wire is screw-fixed to the power supply board 17.

Figure 3:
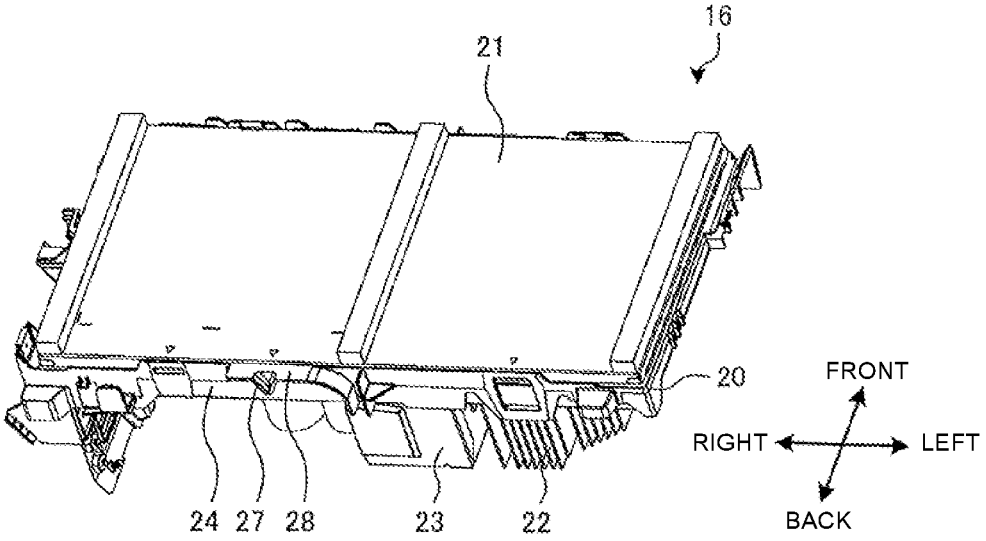
FIG. 3 is a perspective view of the electrical component unit according to Embodiment 1 of the present invention as viewed from the back.
Figure 4:
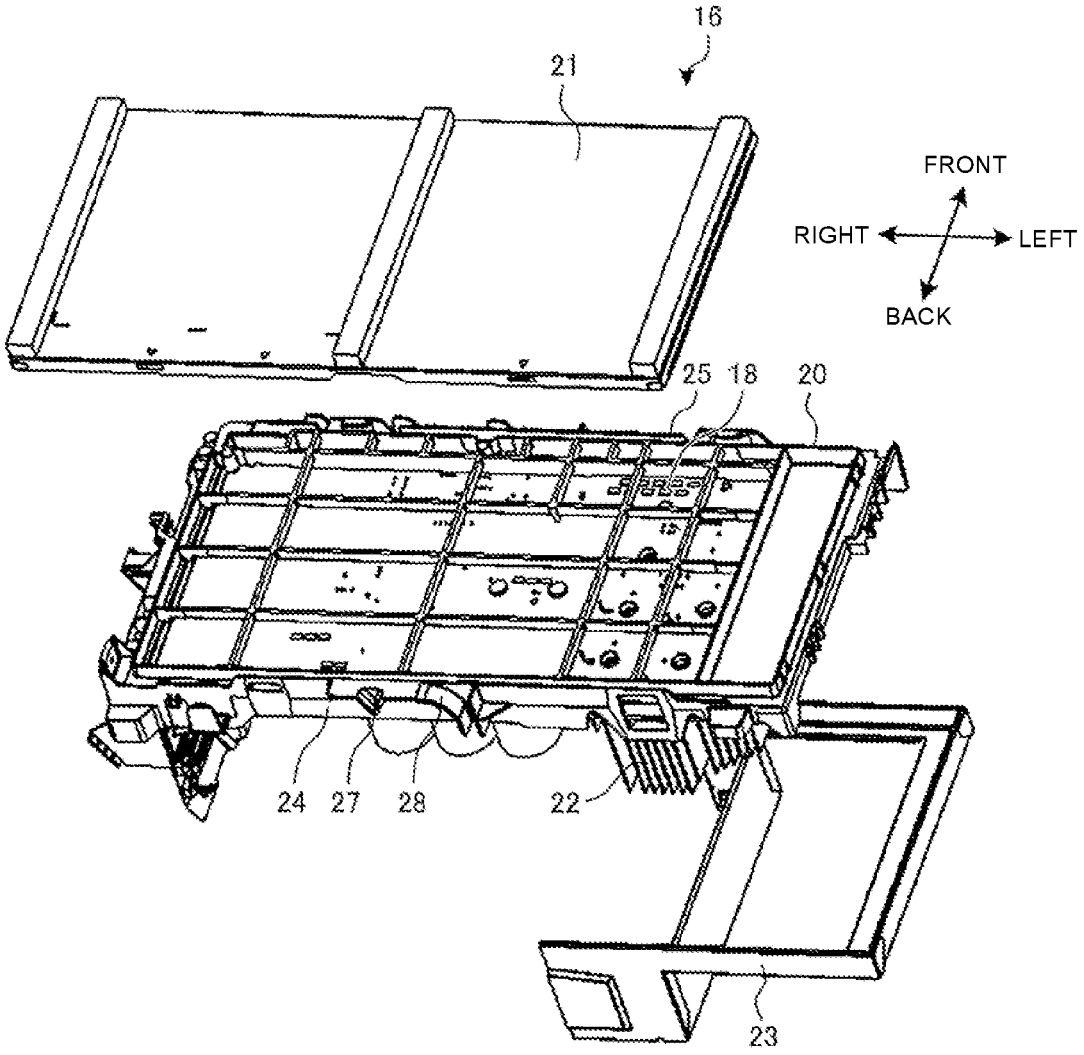
FIG. 4 is an exploded perspective view of the electrical component unit according to Embodiment 1 of the present invention as viewed from the back.

FIG. 3 is a perspective view of the electrical component unit 16 according to Embodiment 1 of the present invention as viewed from the back. FIG. 4 is an exploded perspective view of the electrical component unit 16 according to Embodiment 1 of the present invention as viewed from the back. As shown in FIGS. 3 and 4, the electrical component unit 16 includes a board fixing frame 20 that holds the control board 18 and a board protection sheet metal 21 that covers the upper part of the board fixing frame 20 and protects the control board 18. A heat sink 22 for assisting heat release is mounted on the control board 18. The heat sink 22 is fixed to the lower part of the board fixing frame 20 by a heat sink fixing sheet metal 23. Here, the board fixing frame 20 corresponds to a holder of the present invention.

Figure 5:
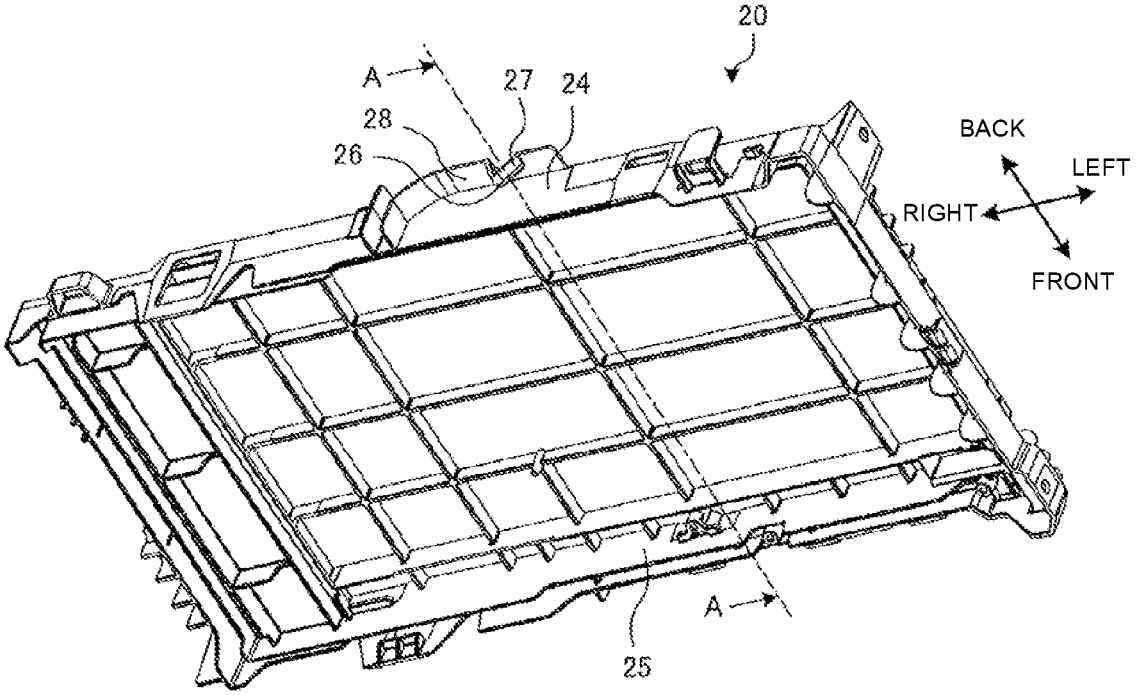
FIG. 5 is a perspective view of the board fixing frame according to Embodiment 1 of the present invention as viewed from a back.
Figure 6:
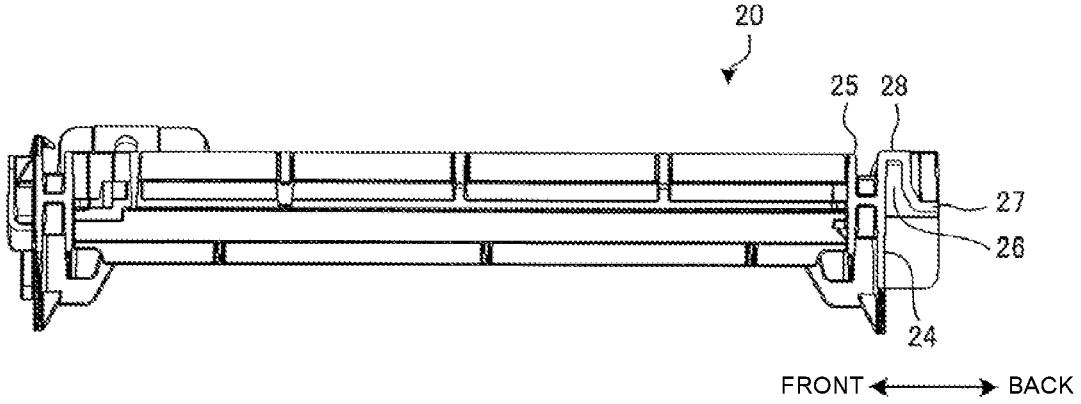
FIG. 6 is an explanatory view of the A-A cross section of FIG. 5 showing the board fixing frame according to Embodiment 1 of the present invention.

FIG. 5 is a perspective view of the board fixing frame 20 according to Embodiment 1 of the present invention as viewed from the back. FIG. 6 is an explanatory view of the A-A section of FIG. 5 showing the board fixing frame 20 according to Embodiment 1 of the present invention. As shown in FIGS. 5 and 6, the back surface of the board fixing frame 20 has a contact surface portion 24 that comes in contact with the partition plate 7 when the outdoor unit 100 of an air-conditioning apparatus is assembled. Here, a part of the board fixing frame 20 leading to the contact surface portion 24 that holds the control board 18 constitutes a main body portion 25.

The back surface of the board fixing frame 20 has a downward protruding V-shaped positioning protrusion 27 that has a gap 26 between positioning protrusion 27 and the contact surface portion 24. The positioning protrusion 27 is V-shaped in cross section, and a V-shaped cross section is formed to have a finite width in the front-back direction. Since the positioning protrusion 27 has a finite width, the distal end portion comes into line contact with a receiving surface portion 29 and inclined surface portions 32 that are described later and can slide stably. The positioning protrusion 27 is connected by a rib 28 that causes the upper base portion thereof to protrude from the main body portion 25 to the back, and has a gap 26 extending in the front-back direction between the positioning protrusion 27 and the main body portion 25 holding the control board 18 of the board fixing frame 20. The positioning protrusion 27 may be provided in a shape other than a V shape, for example, it may be provided in a U shape. The positioning protrusion 27 may have a hemispherical distal end having no finite width in the front-back direction.

Figure 7:
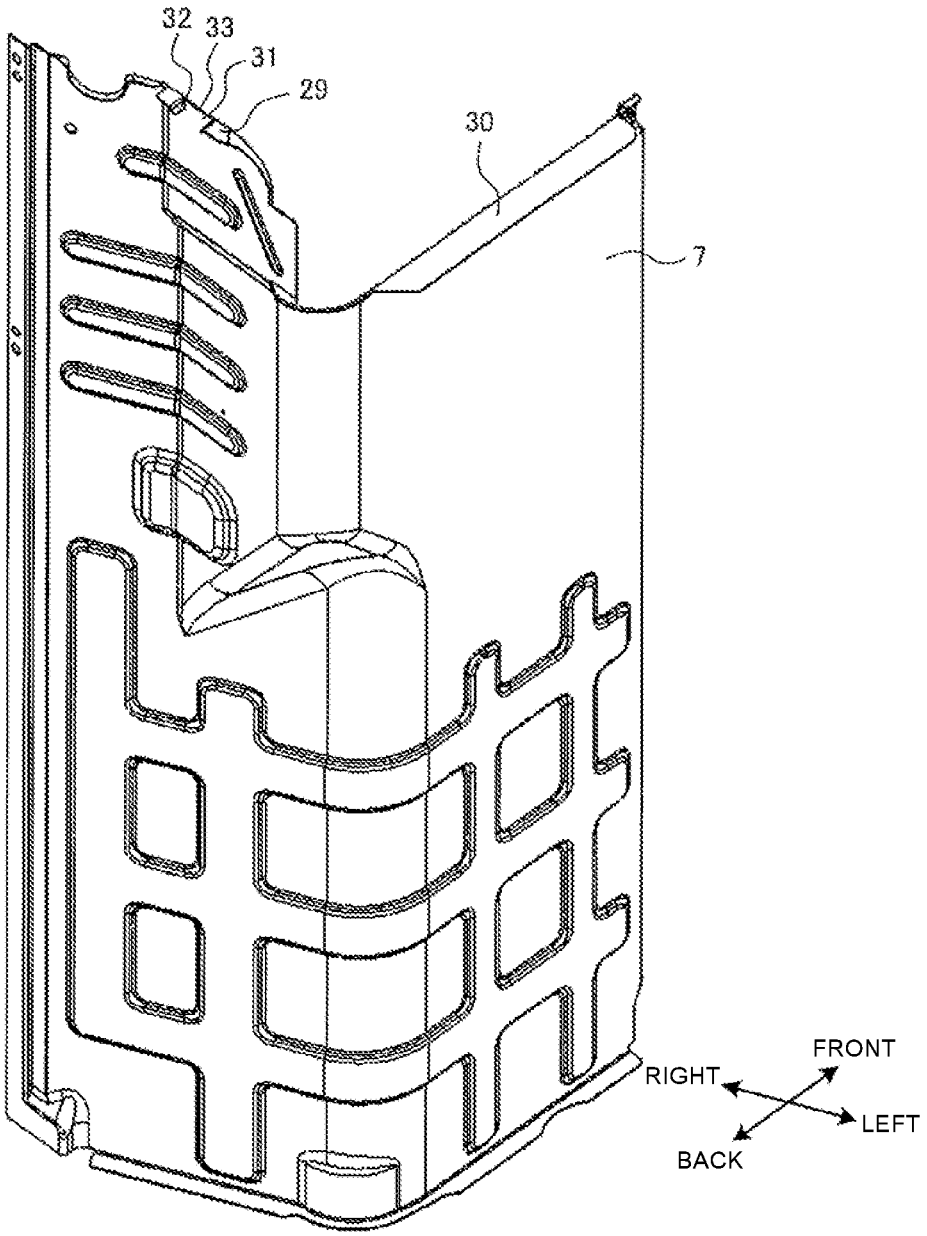
FIG. 7 is a perspective view of the partition plate according to Embodiment 1 of the present invention as viewed from the back.
Figure 8:
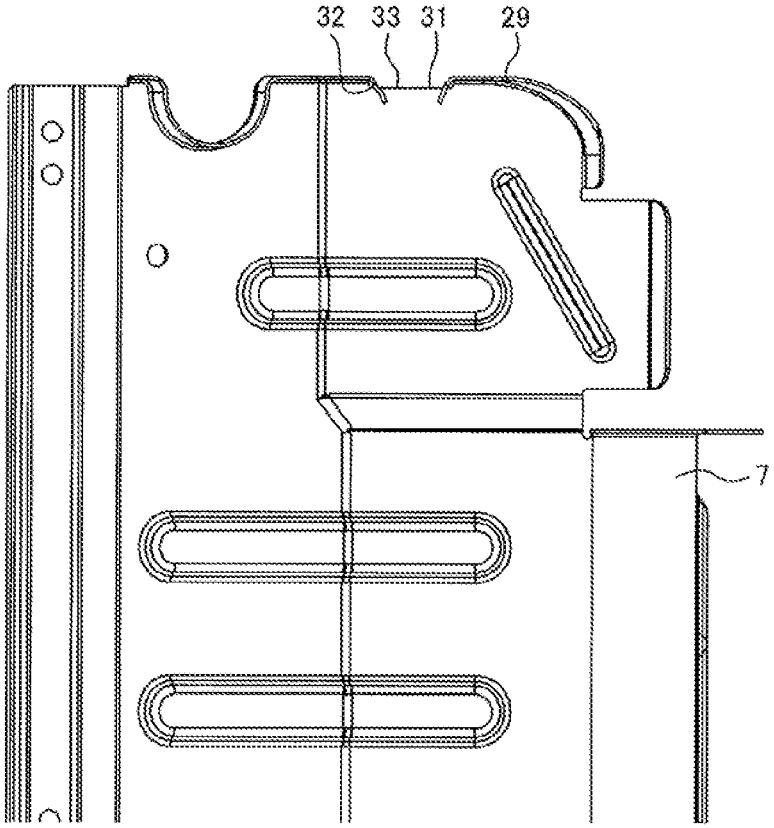
FIG. 8 is an enlarged back view showing the upper part of the partition plate according to Embodiment 1 of the present invention as viewed from the back.

FIG. 7 is a perspective view of the partition plate 7 according to Embodiment 1 of the present invention as viewed from the back. FIG. 8 is an enlarged back view showing the upper part of the partition plate 7 according to Embodiment 1 of the present invention as viewed from the back. As shown in FIGS. 7 and 8, a planar receiving surface portion 29 for receiving the board fixing frame 20 is provided in the upper part of the standing partition plate 7. The receiving surface portion 29 comes into contact with the rib 28 of the board fixing frame 20, and the electrical component unit 16 is supported by the partition plate 7. Therefore, the receiving surface portion 29 has substantially the same shape as the rib 28 so that the rib 28 can be put on the receiving surface portion 29. When the electrical component unit 16 is mounted, the positioning protrusion 27 of the board fixing frame 20 contacts and slides on the receiving surface portion 29. A planar supporting surface portion 30 for receiving the board fixing frame 20 in the front-back direction is provided in the upper part of the portion bent forward of the upright partition plate 7.

The receiving surface portion 29 is provided with, in its middle part, a cutout portion 31 into which the positioning protrusion 27 is inserted. The cutout portion 31 is a space, and when the receiving surface portion 29 and the rib 28 of the board fixing frame 20 are brought into contact with each other, the positioning protrusion 27 is caused to protrude downward.

Inclined surface portions 32 that are inclined downward from the receiving surface portion 29 and guide the positioning protrusion 27 to the cutout portion 31 are provided at end portions of the receiving surface portion 29 that lead to the cutout portion 31. The inclined surface portions 32 are bent obliquely downward from the receiving surface portion 29. The inclined surface portions 32 are formed in a pair on both left and right sides of the cutout portion 31. The inclined surface portions 32 are inclined at an angle along the V-shaped finite width side surface of the positioning protrusion 27. Therefore, the inclined surface portions 32 are brought into contact with the base portion of the positioning protrusion 27 in a state where the positioning protrusion 27 is inserted into the cutout portion 31 and the fixing position of the electrical component unit 16 is determined in the upper part of the partition plate 7.

As shown in FIG. 7, the partition plate 7 having the receiving surface portion 29 and the inclined surface portions 32 is made of a sheet of metal. The receiving surface portion 29 is formed by bending the upper part of the upright partition plate 7. The inclined surface portions 32 are formed by cutting a part of the receiving surface portion 29 from the partition plate 7 at the bending portion of the receiving surface portion 29 and bending it downward. The upper end portion 33 of the partition plate 7 adjacent to the cutout portion 31 has substantially the same height as the receiving surface portion 29.

Figure 9:
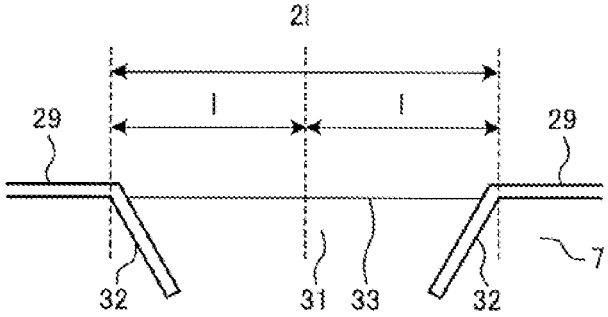
FIG. 9 is a diagram showing a model of the inclined surface portions of the partition plate according to Embodiment 1 of the present invention.

FIG. 9 is a diagram showing a model of the inclined surface portions 32 of the partition plate 7 according to Embodiment 1 of the present invention. As shown in FIG. 9, the length of the inclined surface portions 32 and the cutout portion 31 in the left-right horizontal direction is defined as 2l. In this case, the pair of inclined surface portions 32 that is line-symmetrical relative to the left-right center line of the cutout portion 31 can be formed to have a maximum length l of half of 2l. The pair of left and right inclined surface portions 32 may have different lengths. One of the inclined surface portions 32 may be formed to be longer than the maximum length l, and the other may be formed to be shorter than the maximum length l. Both of the pair of inclined surface portions 32 may be formed to be shorter than the maximum length l. Only one of the inclined surface portions 32 may be formed.

Figure 10:
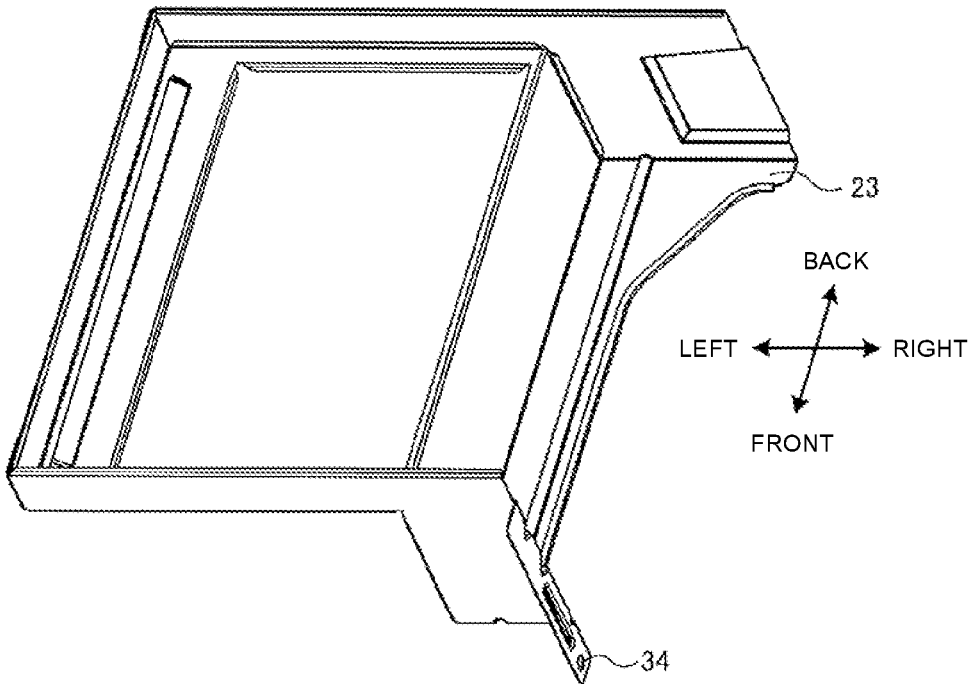
FIG. 10 is a perspective view showing the heat sink fixing sheet metal according to Embodiment 1 of the present invention.

FIG. 10 is a perspective view showing the heat sink fixing sheet metal 23 according to Embodiment 1 of the present invention. As shown in FIG. 10, the heat sink fixing sheet metal 23 has, in its front part, a screw-fixing portion 34 that is screw-fixed in a state where the positioning protrusion 27 is inserted into the cutout portion 31 and the fixing position of the electrical component unit 16 is determined in the upper part of the partition plate 7. By screw-fixing the screw fixing portion 34 to the partition plate 7, the electrical component unit 16 is fixed to the partition plate 7. The screw-fixing portion 34 is, for example, a screw hole. The partition plate 7 has a screw-fixing area (not shown) to which the screw-fixing portion 34 is screw-fixed. In a state where the positioning protrusion 27 is inserted into the cutout portion 31 and the fixing position of the electrical component unit 16 is determined in the upper part of the partition plate 7, the screw insertion position of the screw-fixing portion 34 coincides with the screw insertion position of the screw fixing portion of the partition plate 7.

Figure 11:
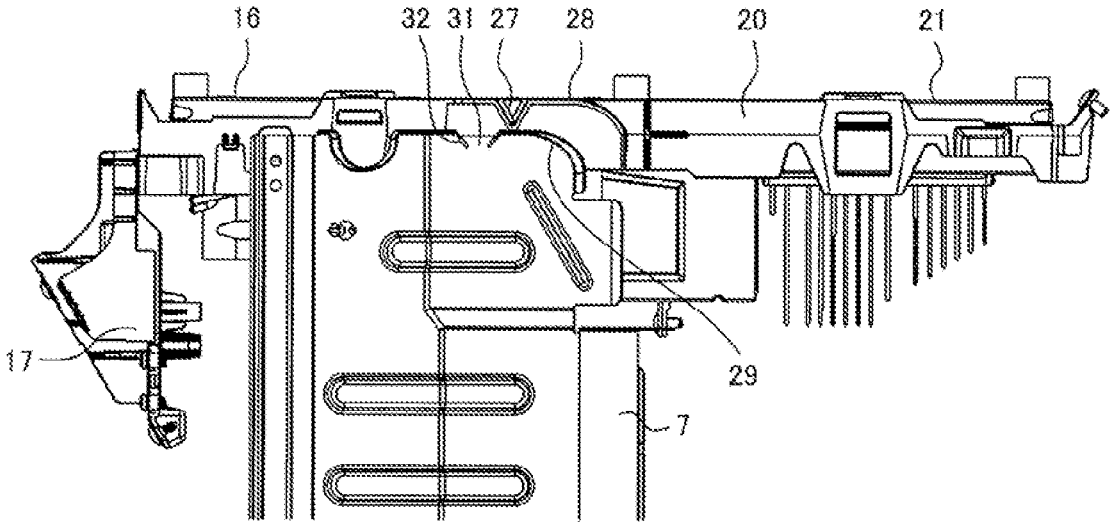
FIG. 11 is a back view showing a state where the positioning protrusion according to Embodiment 1 of the present invention is slid on the receiving surface portion as viewed from the back.
Figure 12:
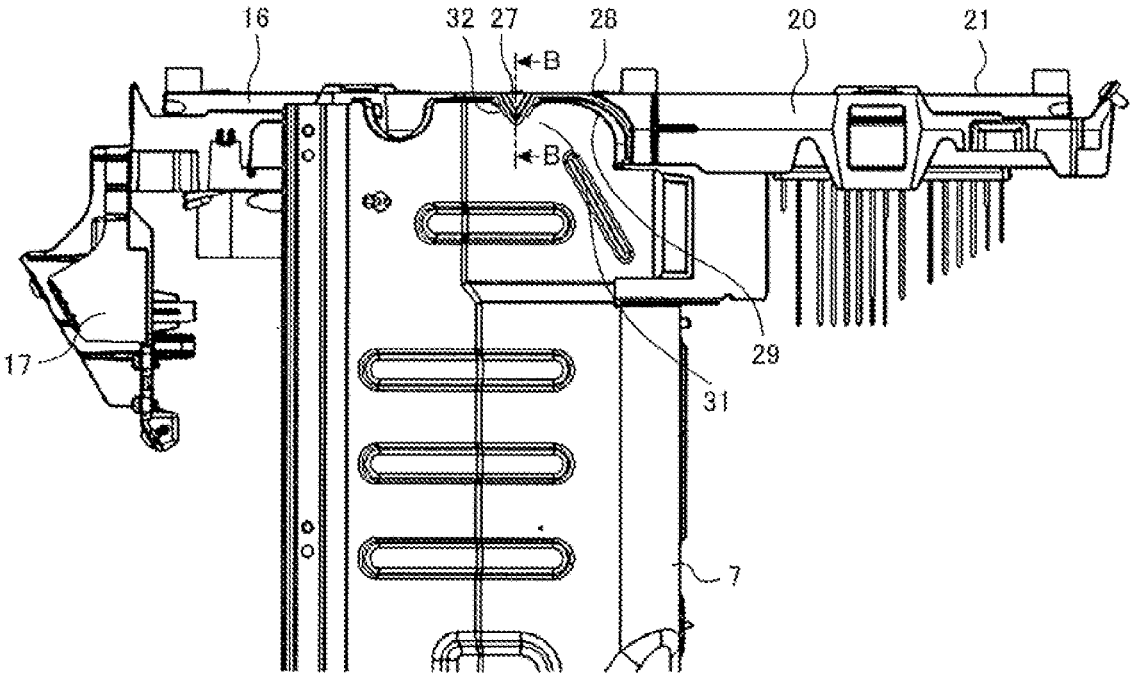
FIG. 12 is a back view showing a state where the positioning protrusion according to Embodiment 1 of the present invention is inserted into the cutout portion as viewed from the back.
Figure 13:
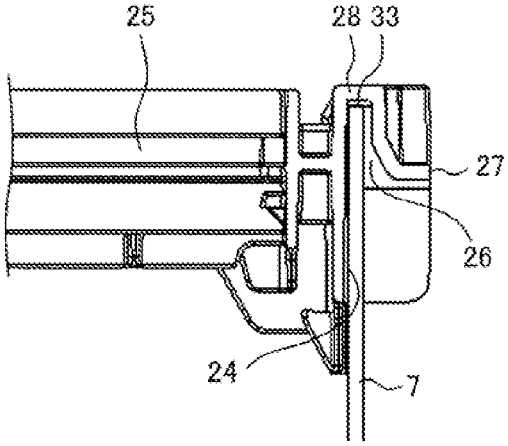
FIG. 13 is an explanatory view of the B-B cross section of FIG. 12 showing a state where the positioning protrusion according to Embodiment 1 of the present invention is inserted into the cutout portion.
Figure 14:
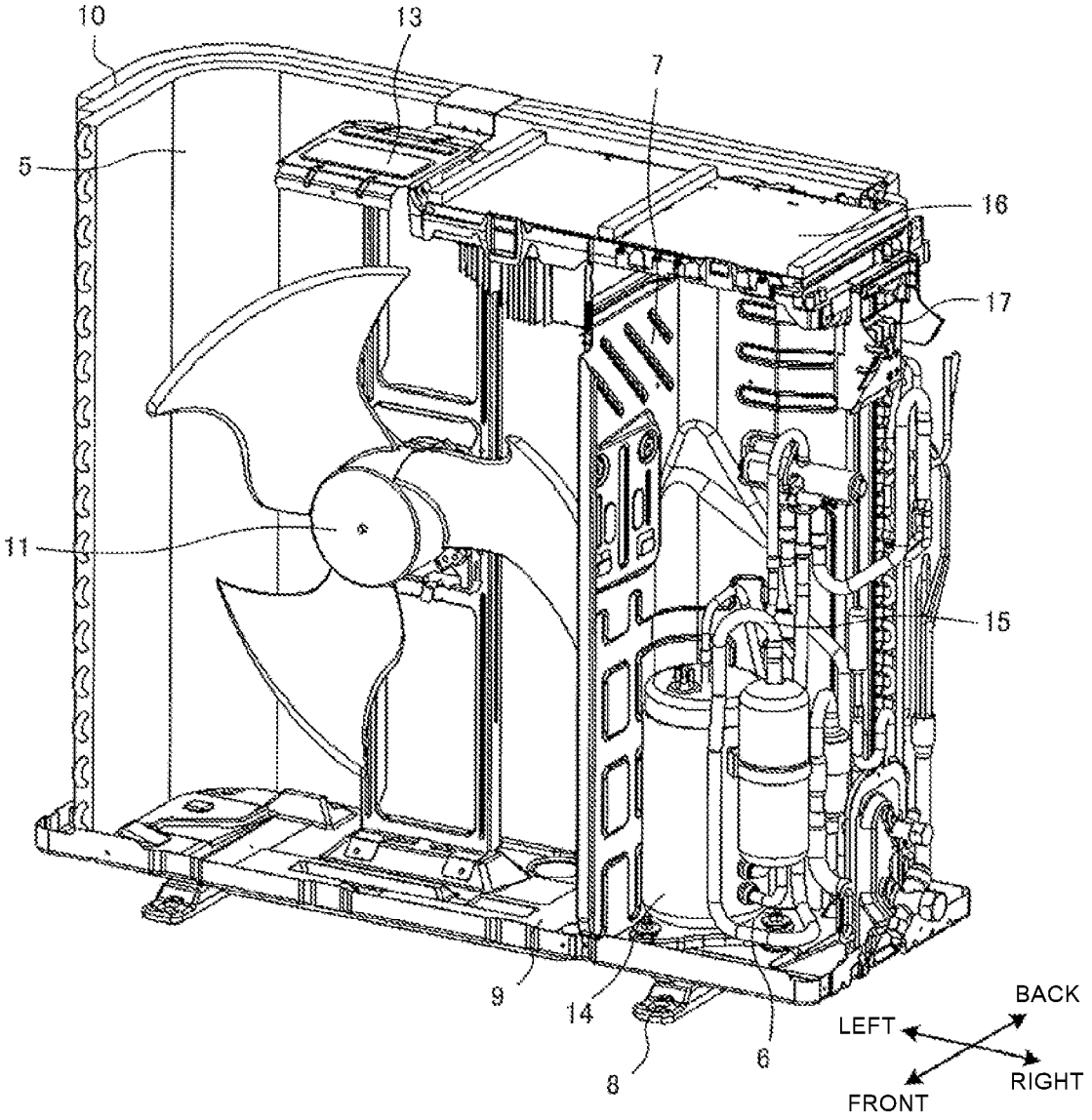
FIG. 14 is a perspective view showing a state where the electrical component unit according to Embodiment 1 of the present invention is mounted on the partition plate.

FIG. 11 is a back view showing a state where the positioning protrusion 27 according to Embodiment 1 of the present invention is slid on the receiving surface portion 29 as viewed from the back. FIG. 12 is a back view showing a state where the positioning protrusion 27 according to Embodiment 1 of the present invention is inserted into the cutout portion 31 as viewed from the back. FIG. 13 is an explanatory view of the B-B cross section of FIG. 12 showing a state where the positioning protrusion 27 according to Embodiment 1 of the present invention is inserted into the cutout portion 31. FIG. 14 is a perspective view showing a state where the electrical component unit 16 according to Embodiment 1 of the present invention is mounted on the partition plate 7.

The electrical component unit 16 is temporarily placed in a state where the distal end of the positioning protrusion 27 of the board fixing frame 20 is in contact with the receiving surface portion 29 of the partition plate 7. In this temporarily placed state, the contact surface portion 24 of the main body portion 25 holding the control board 18 of the board fixing frame 20 is in contact with the front side of the partition plate 7 for a period of time including a time when the positioning protrusion 27 is thereafter guided to the cutout portion 31 by the receiving surface portion 29 and the inclined surface portions 32. Then, as shown in FIG. 11, the manufacturing worker slides the electrical component unit 16 in a temporarily placed state in the left-right direction of the outdoor unit 100 of an air-conditioning apparatus, so that the positioning protrusion 27 slides into the cutout portion 31 via the receiving surface portion 29 and the inclined surface portions 32. As shown in FIG. 12, the positioning protrusion 27 is inserted into the cutout portion 31. As a result, the fixing position of the electrical component unit 16 is determined. As shown in FIG. 13, the upper end portion 33 of the partition plate 7 adjacent to the cutout portion 31 enters the gap 26 between the main body portion 25 of the board fixing frame 20 and the positioning protrusion 27 when the positioning protrusion 27 is inserted into the cutout portion 31 and the fixing position of the electrical component unit 16 is determined in the upper part of the partition plate 7. Thereafter, the electrical component unit 16 is screw-fixed horizontally to the partition plate 7 at the screw-fixing portion 34 provided in the heat sink fixing sheet metal 23. As a result, the state where the electrical component unit 16 is mounted on the partition plate 7 as shown in FIG. 14 is completed.

According to Embodiment 1, the outdoor unit 100 of an air-conditioning apparatus includes a fan chamber 5 in which a propeller fan 11 is provided and a machine chamber 6 in which a compressor 14 is provided. The outdoor unit 100 of an air-conditioning apparatus includes an upright partition plate 7 separating the fan chamber 5 and the machine chamber 6. The outdoor unit 100 of an air-conditioning apparatus includes an electrical component unit 16 having a control board 18 on which electrical components for controlling the air-conditioning apparatus are mounted and a board fixing frame 20 that holds the control board 18 and is fixed to the upper part of the partition plate 7. The partition plate 7 is provided with, in its upper part, a planar receiving surface portion 29 for receiving the board fixing frame 20. The board fixing frame 20 is provided with a positioning protrusion 27 protruding downward. A cutout portion 31 into which the positioning protrusion 27 is inserted is formed in the receiving surface portion 29. Inclined surface portions 32 that are inclined downward from the receiving surface portion 29 and guide the positioning protrusion 27 to the cutout portion 31 are provided at end portions of the receiving surface portion 29 that lead to the cutout portion 31.

Due to this configuration, the positioning protrusion 27 is smoothly guided to the cutout portion 31 by the inclined surface portions 32, and the positioning protrusion 27 can be positioned in the cutout portion 31. Therefore, when the electrical component unit 16 is mounted, the fixing position of the electrical component unit 16 is easily determined, and the work efficiency at the time of manufacturing can be improved. Further, since the positioning protrusion 27 is guided downward by the inclined surface portions 32, the impact on the electrical component unit 16 caused by falling of the electrical component unit 16 for a distance corresponding to the height of the positioning protrusion 27 when the positioning protrusion 27 is positioned in the cutout portion 31 can be mitigated. Therefore, the electrical component unit 16 is less likely to malfunction, and the electrical component unit 16 can be mounted.

According to Embodiment 1, the inclined surface portions 32 come into contact with the base portion of the positioning protrusion 27 in a state where the positioning protrusion 27 is inserted into the cutout portion 31 and the fixing position of the electrical component unit 16 is determined in the upper part of the partition plate 7.

According to this configuration, the inclined surface portions 32 come into contact with the base portion of the positioning protrusion 27, and the positioning protrusion 27 can stably be positioned in the cutout portion 31. Therefore, the fixing position of the electrical component unit 16 is accurately determined in the upper part of the partition plate 7, work such as screw-fixing to the electrical component unit 16 after positioning can be performed quickly, and the work efficiency at the time of manufacturing can be improved.

According to Embodiment 1, the partition plate 7 having the receiving surface portion 29 and the inclined surface portions 32 is made of a sheet of metal. The receiving surface portion 29 is formed by bending the upper part of the partition plate 7. The inclined surface portions 32 are formed by cutting a part of the receiving surface portion 29 and bending it downward.

According to this configuration, simplification of configuration can be obtained, the number of parts can be reduced, and cost reduction can be achieved.

According to Embodiment 1, the inclined surface portions 32 are formed in pairs on both sides of the cutout portion 31 by cutting a part of the receiving surface portion 29.

According to this configuration, the positioning protrusion 27 is smoothly guided from either side of the cutout portion 31 by the pair of inclined surface portions 32, and the positioning protrusion 27 can be positioned in the cutout portion 31.

According to Embodiment 1, a gap 26 is provided between the positioning protrusion 27 and the main body portion 25 holding the control board 18 of the board fixing frame 20. The upper end portion 33 of the partition plate 7 adjacent to the cutout portion 31 enters the gap 26 when the positioning protrusion 27 is inserted into the cutout portion 31 and the fixing position of the electrical component unit 16 is fixed in the upper part of the partition plate 7.

Due to this configuration, the upper end portion 33 of the partition plate 7 adjacent to the cutout portion 31 enters the gap 26, and the electrical component unit 16 can be prevented from being displaced away from the partition plate 7 in the front-back direction. Further, at this time, since the positioning protrusion 27 is inserted into the cutout portions 31, the electrical component unit 16 can also be prevented from being displaced in the left-right direction and the vertical direction. Therefore, the fixing position of the electrical component unit 16 is accurately determined in the upper part of the partition plate 7 in all directions, and work such as screw-fixing to the electrical component unit 16 after positioning can be performed quickly, and the work efficiency at the time of manufacturing can be improved.

According to Embodiment 1, the positioning protrusion 27 is V-shaped.

Due to this configuration, it is possible to reduce the area where the lower end of the positioning protrusion 27 contacts the receiving surface portion 29 and the inclined surface portions 32. Therefore, the positioning protrusion 27 can smoothly move relative to the receiving surface portion 29 and the inclined surface portions 32.

According to Embodiment 1, there is provided a screw-fixing portion 34 that is screw-fixed in a state where the positioning protrusion 27 is inserted into the cutout portion 31 and the fixing position of the electrical component unit 16 is determined in the upper part of the partition plate 7.

According to this configuration, after the fixing position of the electrical component unit 16 is accurately determined in the upper part of the partition plate 7, the electrical component unit 16 can be easily screw-fixed to the partition plate 7 at the screw-fixing portion 34, and the work efficiency at the time of manufacturing can be improved.

According to Embodiment 1, the main body portion 25 holding the control board 18 of the board fixing frame 20 comes into contact with the partition plate 7 when the positioning protrusion 27 is guided to the cutout portion 31 by the receiving surface portion 29 and the inclined surface portions 32.

According to this configuration, it is possible to prevent a situation where the main body portion 25 holding the control board 18 of the board fixing frame 20 does not come into contact with the partition plate 7, the electrical component unit 16 is separated from the partition plate 7, and the positioning protrusion 27 cannot determine the guide position relative to the receiving surface portion 29 and the inclined surface portions 32. Therefore, the positioning protrusion 27 is smoothly guided to the cutout portion 31 by the receiving surface portion 29 and the inclined surface portions 32.

It should be noted that embodiments disclosed above are examples in all respects and are not restrictive. It is intended that the scope of the present invention is defined not by the above description but by the claims and includes all modifications within meaning and scope equivalent to the claims.

REFERENCE SIGNS LIST front plate 2 side plate 3 top plate 4 protective cover 5 fan chamber 6 machine chamber 7 partition plate 8 leg portion 9 bottom plate 10 heat exchanger 11 propeller fan 12 motor 13 motor mounting base 14 compressor 15 refrigerant pipe 16 electrical component unit 17 power supply board 18 control board 19 terminal block 20 board fixing frame 21 board protection sheet metal 22 heat sink 23 heat sink fixing sheet metal 24 contact surface portion 25 main body portion 26 gap 27 positioning protrusion 28 rib 29 receiving surface portion 30 supporting surface portion 31 cutout portion 32 inclined surface portion 33 upper end portion 34 screw-fixing portion 100 outdoor unit

The invention claimed is:

1. An outdoor unit of an air-conditioning apparatus comprising:

a fan chamber in which a fan is provided and a machine chamber in which a compressor is provided;

a partition plate separating the fan chamber and the machine chamber; and an electrical component unit having a control board on which an electrical component is mounted and a holder that holds the control board, the holder being fixed to an upper part of the partition plate, wherein the partition plate is provided with, in its upper part, a planar receiving surface portion for receiving the holder, wherein the holder is provided with a positioning protrusion protruding downward, wherein a cutout portion into which the positioning protrusion is inserted is formed in the receiving surface portion, and wherein at least one inclined surface portion that is inclined downward from the receiving surface portion and guides the positioning protrusion to the cutout portion is provided at an end portion of the receiving surface portion that leads to the cutout portion.

2. The outdoor unit of an air-conditioning apparatus of claim 1, wherein the partition plate having the receiving surface portion and the at least one inclined surface portion is made of a sheet of metal, wherein the receiving surface portion is formed by bending the upper part of the partition plate, and wherein the at least one inclined surface portion is formed by cutting a part of the receiving surface portion and bending it downward.

3. The outdoor unit of an air-conditioning apparatus of claim 2, wherein the at least one inclined surface portion comprise a pair of inclined surface portions formed on both sides of the cutout portion by cutting a part of the receiving surface portion.

4. The outdoor unit of an air-conditioning apparatus of claim 1, wherein the positioning protrusion is V-shaped.

5. The outdoor unit of an air-conditioning apparatus of claim 1, wherein in a temporary state of the electrical component unit, prior to the positioning protrusion being guided to the cutout portion by the at least one inclined surface portion, a distal end of the positioning protrusion is in contact with the receiving surface portion, and wherein in the temporary state, a contact surface portion of a main body portion of the holder is in contact with a front side of the partition plate until the positioning protrusion is guided to the cutout portion by the at least one inclined surface portion.

6. The outdoor unit of an air-conditioning apparatus of claim 1, wherein the at least one inclined surface portion comes into contact with a base portion of the positioning protrusion in a state where the positioning protrusion is inserted into the cutout portion and a fixing position of the electrical component unit is determined in the upper part of the partition plate.

7. The outdoor unit of an air-conditioning apparatus of claim 1, wherein the positioning protrusion has a gap between the positioning protrusion and a main body portion holding the control board of the holder, and wherein an upper end portion of the partition plate adjacent to the cutout portion enters the gap when the positioning protrusion is inserted into the cutout portion and a fixing position of the electrical component unit is determined in the upper part of the partition plate.

* * * * *